US010994564B2

(12) United States Patent
Garceau et al.

(10) Patent No.: US 10,994,564 B2
(45) Date of Patent: May 4, 2021

(54) ENHANCED METHOD FOR PRODUCT MARKING

(71) Applicant: Parker-Hannifin Corporation, Cleveland, OH (US)

(72) Inventors: Derek M. Garceau, Cleveland Heights, OH (US); Andrew M. Morgan, Lakewood, OH (US)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

(21) Appl. No.: 16/606,960

(22) PCT Filed: Aug. 6, 2018

(86) PCT No.: PCT/US2018/045326
§ 371 (c)(1),
(2) Date: Oct. 21, 2019

(87) PCT Pub. No.: WO2019/032429
PCT Pub. Date: Feb. 14, 2019

(65) Prior Publication Data

US 2020/0189304 A1 Jun. 18, 2020

Related U.S. Application Data

(60) Provisional application No. 62/543,028, filed on Aug. 9, 2017.

(51) Int. Cl.
*B41M 5/24* (2006.01)
*B41M 5/025* (2006.01)
*B41M 7/00* (2006.01)

(52) U.S. Cl.
CPC ..... *B41M 5/24* (2013.01); *B41M 5/025* (2013.01); *B41M 5/0256* (2013.01); *B41M 7/009* (2013.01); *B41M 7/0081* (2013.01)

(58) Field of Classification Search
CPC .... B41M 5/24; B41M 5/0256; B41M 7/0081; B41M 7/009; B41M 5/025
See application file for complete search history.

(56) References Cited

U.S. PATENT DOCUMENTS 4,941,290 A 7/1990 Holyoke
5,111,523 A 5/1992 Ferlier et al.
(Continued)

FOREIGN PATENT DOCUMENTS

JP 08080669 A * 3/1996 ..... B41M 5/26
WO WO 2004/045857 A2 6/2004

OTHER PUBLICATIONS

International Search Report and Written Opinion of PCT/US2018/045326 dated Jan. 21, 2019.

*Primary Examiner* — Yaovi M Ameh
(74) *Attorney, Agent, or Firm* — Renner, Otto, Boisseile & Sklar, LLP

(57) ABSTRACT

A layline labeling process includes providing a layline material including a carrier film and a plurality of ink regions applied to the carrier film; applying a laser to laser-treat the ink side of the layline material to remove a first portion of ink to form a pattern of labeling; applying the laser treated layline material to a product with the ink side against the product; curing the product; and removing the carrier film after curing, wherein a second portion of ink of the ink regions of the laser treated layline material not removed by the laser treatment remains bonded to an outer layer of the product. Because of the laser treatment to form the pattern of labeling where the ink has been removed from the carrier film, the labeling is visible by the contrast of the outer layer of the product where the ink was burned away, against the remaining ink that has bonded to such outer product layer during curing.

14 Claims, 6 Drawing Sheets

(56) References Cited

U.S. PATENT DOCUMENTS

| | | | | |
|---|---|---|---|---|
| 5,521,629 | A * | 5/1996 | Deboer | B41M 5/24 347/139 |
| 5,803,627 | A * | 9/1998 | Paranjpe | B41J 2/325 400/237 |
| 6,576,862 | B1 * | 6/2003 | Costin | B41M 5/24 219/121.6 |
| 7,419,766 | B2 | 9/2008 | Kimelblat et al. | |
| 8,529,775 | B2 | 9/2013 | Costin et al. | |
| 2004/0241585 | A1 * | 12/2004 | Kato | H05K 3/02 430/311 |
| 2007/0026208 | A1 | 2/2007 | Baker et al. | |
| 2011/0149349 | A1 * | 6/2011 | Siebert | B32B 29/06 358/3.29 |

* cited by examiner

ENHANCED METHOD FOR PRODUCT MARKING

RELATED APPLICATION DATA

This application is a national stage application pursuant to 35 U.S.C. § 371 of PCT/US2018/045326 filed on Aug. 6, 2018, which claims the benefit of U.S. Provisional Application No. 62/543,028 filed on Aug. 9, 2017, which is incorporated herein by reference.

FIELD OF INVENTION

The present invention relates generally to methods of product marking, and more particularly to layline labeling methods by which a product is marked or labeled using a layline film with a pre-applied ink layer.

BACKGROUND

The present disclosure is described in connection with the labeling and marking of hose products, although comparable principles may be applied to marking or labeling of other suitable products. In many conventional labeling processes, hoses are labeled by applying ink directly to the hose's outer cover after the hose is cured, such as by using an inkjet printer or comparable ink printing device. Inkjet and similar printers are expensive and difficult to employ for certain types of products, such as hoses.

Another conventional labeling process involves applying to the product a preprinted label or ink decoration on what is referred to in the art as a layline film, which in the case of hose labeling is applied to the hose cover during manufacturing, prior to curing. The layline material generally includes a backing material and a clear transfer tape or film, often made of polypropylene or Mylar film. The layline material may contain preprinted marketing data, including usually at least a quarter date (e.g., 3Q17) indicating when the hose was produced. The ink for printing the marketing data is generally printed using a conventional silkscreen-type printing process.

With the use of tensioning rollers, a spool of the layline material is uncoiled and applied onto the cover of the hose, applied ink side down against the hose with the clear transfer film layer on top and exposed. As the layline material is applied onto the hose, a curing agent is applied onto the hose/layline material combination. The hose, layline material, and curing agent combination is then coiled onto a reel and the reel enters the vulcanizer to cure the combination. The curing agent is either an extruded plastic cover or a wrapped fabric which jackets the hose assembly during curing. After curing, the curing agent is removed from the hose along with the clear transfer tape or film of the layline material. The result is the hose has the printed backing material of the layline material remaining. The curing process induces heat onto the hose to promote adhesion between the hose and layline ink of the printed material.

Conventional layline labeling has deficiencies. As specified by certain industry standards in the hose and related industries (e.g., SAE, ISO and other industry standards), a minimum amount of product information must be preprinted onto the Mylar or other carrier film. Among other requirements, the information at least minimally needs to include a calendar quarter date (i.e., 2Q17), which represents about a 12-week time period when the hose was produced. Manufacturing schedules, however, are not always precise due to for example market conditions and customer needs, and hose manufacturing at times can be sped up or delayed. Accordingly, any portion of the preprinted layline that becomes out of date is no longer usable, and must be destroyed. This presents a costly waste of materials.

In this regard, the preprinted layline material cannot be updated if not used, nor otherwise altered to include variable information. In some cases, an inkjet printer also may be used, which prints variable data onto the hose separate from the layline material after curing. Variable data may include a production tracking number, specific production date, or other information that may vary as to the hose products. As indicated above, however, inkjet or comparable printing can be expensive and difficult to perform. Because the variable information ink printing is applied after the hose is cured, variation in the hose position as it is unrolled and printed can allow the ink printing to overlap the layline data, causing poor appearance. Even when post-curing ink printing is added, any unused layline that has become out of date still is unusable and must be destroyed as the preprinted layline material cannot be altered, again resulting in significant scrap of unused layline material which is costly.

In other product labeling fields, laser printers have been employed. In conventional laser printing for product labeling applications, typically found on printed cardboard packaging and the like, the material to be marked with the laser is first printed with two ink regions of contrasting colors of ink, including a dark base layer (for example black or red) and a lighter upper layer (e.g., white) printed over the darker base layer. The laser removes the upper layer in the shape of letters or numbers thereby exposing the darker base layer so the characters are readable. Laser printing has not been employed in layline printing applications or processes, including for hose labeling and marking.

SUMMARY OF THE INVENTION

This present disclosure describes an enhanced process used in conjunction with layline product labeling and marking. The disclosed new process creates contrast between the hose cover and the layline label by removing ink from the layline carrier film during a laser treatment process applied to the layline material prior to applying the layline to the hose and curing. The ink may be applied as a single ink layer or a plurality of ink layers. Such process permits removing the conventional preprinted layline quarter date information and relatedly permits variable information to be applied during the hose manufacturing process and prior to curing. In the enhanced layline labeling, a laser generates readable characters by removing ink from the carrier film or Mylar in a patterned fashion to create the characters prior to applying the layline material to hose product. The layline material is adhered to the hose product and the hose product is cured. When the carrier film is removed after curing, the hose cover material creates contrast from the remaining portions of the ink layer that remain bonded to the hose cover, which allows the characters to be read.

An enhanced layline labeling process may therefore proceed as follows. The layline material includes a plurality of ink regions formed on one side of a clear transfer tape or carrier film, such as a polypropylene or Mylar film. The layline material contains pertinent data relative to the product (e.g., a hose), as well as a plurality of ink regions for laser marking. For example, the ink regions may be configured as white ink boxes. The ink regions serve as a print area for the laser to mark variable information, such for example a MMDDYY date code, production information like lot number, etc., and any other desired product information, which can be variable information. With the use of tensioning rollers, the layline material is uncoiled and presented in-line to the laser, which laser marks the ink regions that again are formed on the opposite side of the layline material relative to a side exposing only the clear carrier film. The layline material is then applied to the hose and cured, with the curing process setting in the laser marking. Depending on the type of layline, the laser will ablate one or two layers of in the ink regions of the layline material. The high temperature that the hose undergoes during curing facilitates the transfer of ink away from the ink regions onto the hose, and further facilitates separating of carrier film that is stripped away.

An enhanced layline labeling process may include the steps of: providing a layline material including a carrier film and a plurality of ink regions applied to an ink side of the carrier film; applying a laser to laser-treat the ink side of the layline material to remove a first portion of ink from the carrier film to form a pattern (e.g., characters) of labeling; applying the laser treated layline material to a product (e.g., a hose) with the ink side against the product; curing the product; and removing the carrier film after curing, wherein a second portion of ink of the ink regions of the laser treated layline material not removed by the laser treatment remains bonded to an outer layer of the product (e.g., hose cover) to provide contrast with the pattern of labeling. Because of the laser treatment to form the pattern of labeling where the ink has been removed from the carrier film, the labeling is visible by the contrast of the outer layer of the product (e.g., hose cover or optionally a second background layer of ink) where the ink was burned away, against the remaining ink that has remained bonded to such outer product layer during curing.

Advantages of the enhanced layline labeling of the present disclosure overcome the deficiencies of conventional layline processes. The present invention permits removal of the quarter date from the layline material, which eliminates the expiration concern by which the layline can become out of date. In addition, variable information can be labeled on the hose during the layline processes, which eliminates the need to add a separate ink print operation after the layline has been applied and the product cured. This in turn avoids costs associated with ink printing, including avoiding ink and solvent cleaner costs related to ink printing. In addition to cost enhancement, environmental advantages are achieved by the elimination of ink processing supply needs, as well as increased power consumption that is needed for the additional printing. The enhanced layline labeling further results in improvement of the finished product appearance, as variable data is printed on the existing layline and is easier to read than secondary ink printing, which may overlap the layline in conventional processes. There in turn is a reduced overall cost since laser printers as employed in the present invention have an expected lifespan of approximately 25% to 50% greater than the lifespan of analogous ink printers.

These and further features of the present invention will be apparent with reference to the following description and attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the spirit and terms of the claims appended hereto. Features that are described and/or illustrated with respect to one embodiment may be used in the same way or in a similar way in one or more other embodiments and/or in combination with or instead of the features of the other embodiments.

DETAILED DESCRIPTION

Figure 1:
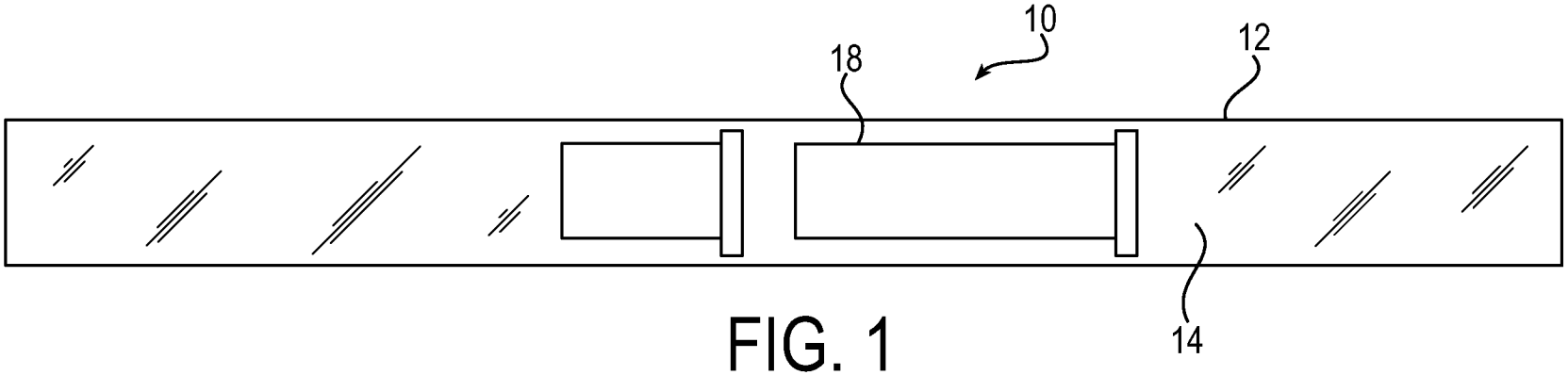
FIG. 1 is a drawing depicting an exemplary layline material for use in embodiments of the methods of the present invention, having a single-layer print area configuration.

Embodiments of the present invention will now be described with reference to the drawings, wherein like reference numerals are used to refer to like elements throughout. It will be understood that the figures are not necessarily to scale.

FIG. 1 is a drawing depicting an exemplary layline material 10 for use in embodiments of the methods of the present invention. The layline material 10 includes a base carrier film 12 including a first side 14 comprising an ink side, and a second non-ink side opposite from the first side. The non-ink side actually faces the reader in the figure, and with the carrier film being a clear film, the carrier film allows the reader to read any printed material and view the ink on the ink side. The layline material 10 further includes a plurality of ink regions 18 applied to the ink side 14 of the carrier film 12. To provide easily labeling of multiple products, the layline material may be provided in a spool with multiple ink regions that may be cut so that a portion of the layline material including at least one ink region ultimately may be applied respectively to a given product. In this example, the ink regions 18 are depicted as white ink regions, in that white ink may be visible when applied to a dark hose cover. Any suitable ink color for the ink regions may be employed.

The carrier film 12 may be a Mylar film or other suitable clear film as may be employed for layline labeling as are known in the art. Similar clear plastic films, such as polyethylene films and polypropylene films, may be employed as the carrier film 12. The ink regions 18 may be applied to the ink side 14 of the carrier film 12 by known and conventional silk-screening processes as are commonly used in layline labeling. Any ink suitable for layline printing also may be employed.

Figure 2:
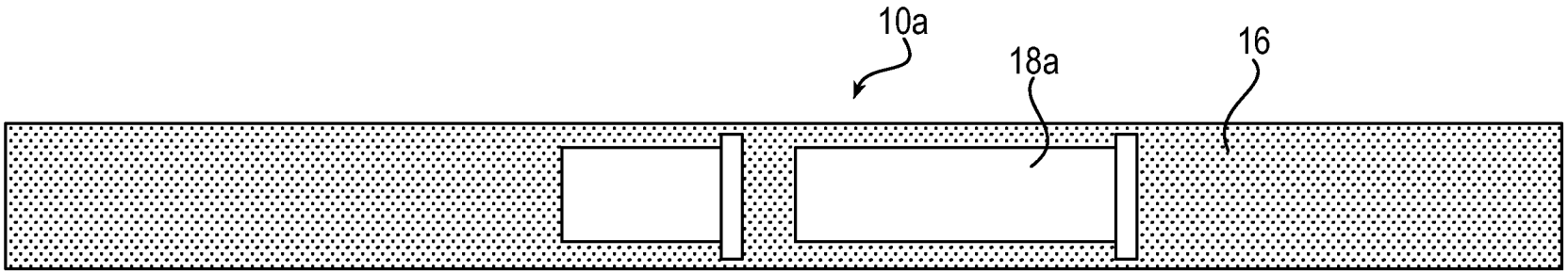
FIG. 2 is a drawing depicting another exemplary layline material for use in embodiments of the methods of the present invention, having a two-layer print area configuration.

The example of FIG. 1 is referred to as a single-layer print area configuration, in that there is a single layer of ink in ink regions 18 applied directly to the carrier film 12 (e.g., white boxes applied to clear carrier film). FIG. 2 is a drawing depicting another exemplary layline material 10*a* for use in embodiments of the methods of the present invention, illustrating an alternative two-layer print area configuration. In the two-layer configuration, ink boxes 18*a* (white in the figure) are applied to the carrier film 12 on the ink side comparable to the ink regions 18 of the previous embodiment. A labeling layer of ink (black in the figure) optionally may then be applied. A second background ink layer 16 (yellow in the figure) then may be applied so as to form a contrasting ink layer relative to the ink regions 18*a*. Accordingly, the ink layers as set forth are visible through the transparent carrier film 12 in the manner seen in FIG. 2. In this example, the ink regions 18*a* are depicted as white ink regions visible against the yellow ink layer 16, in that a white/yellow ink combination may be visible when applied to a dark hose cover. Again, any suitable ink colors for the ink regions and the second background ink layer may be employed. The example of FIG. 2 is referred to as a two-layer print area configuration, in that there is a double layer of ink including an ink layer of regions 18*a* and second background ink layer 16, which are applied to the carrier film (e.g., white boxes applied first to carrier film followed by application of yellow background ink layer).

An enhanced layline labeling process may include the steps of: providing a layline material including a carrier film and a plurality of ink regions applied to an ink side of the carrier film (e.g., such as the layline material 10 of FIG. 1 or 10*a* of FIG. 2); applying a laser to laser-treat the ink side of the layline material to remove a first portion of ink from the carrier film to form a pattern (e.g., characters) of labeling; applying the laser treated layline material to a product (e.g., a hose) with the ink side against the product; curing the product; and removing the carrier film after curing, wherein a second portion of ink of the ink regions of the laser treated layline material not removed by the laser treatment remains bonded to an outer layer of the product (e.g., hose cover) to provide contrast with the pattern of labeling. Because of the laser treatment to form the pattern of labeling where the ink has been removed from the carrier film, the labeling is visible by the contrast of the outer layer of the product (e.g., hose cover) where the ink was burned away, against the remaining ink that has bonded to such outer product layer during curing. The details of such processing steps are illustrated with reference to the figures below.

Figure 3:
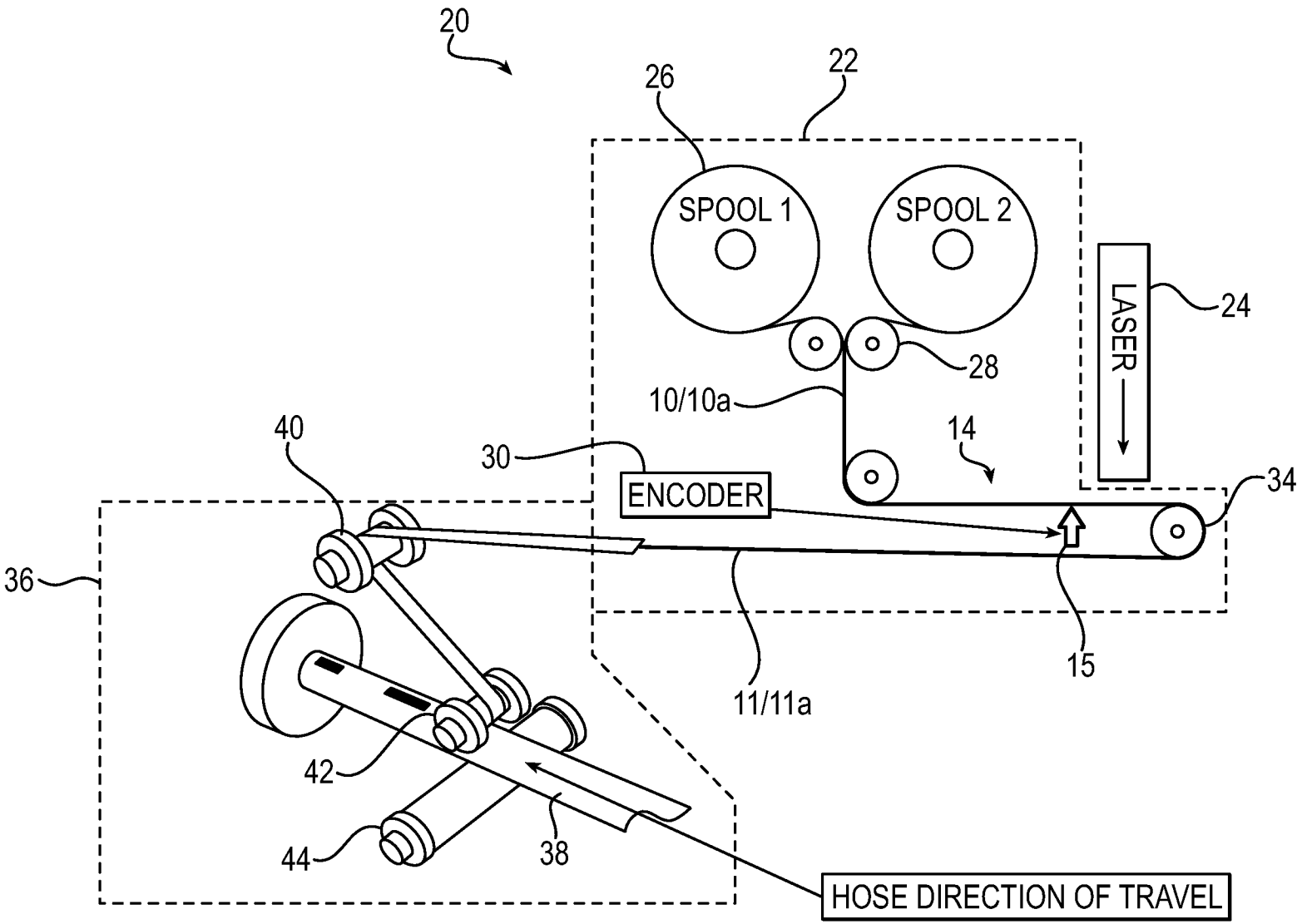
FIG. 3 is a drawing depicting a block diagram of an exemplary layline laser labeling system for use in embodiments of the methods of the present invention.

FIG. 3 is a drawing depicting a block diagram of an exemplary layline laser labeling system 20 for use in embodiments of the methods of the present invention. Generally, the layline laser labeling system 20 includes a feeding mechanism 22 in combination with a laser marking device 24, and the feeding mechanism feeds the layline material to the laser device. The feeding mechanism 22 may include a spool 26 from which spooled source layline material 10 (or 10*a*) is provided. Two separate spool sources are shown in this exemplary embodiment, one being in use at any given time and the other in queue for production without having to employ additional tooling or adjustment. The layline material 10 (or 10*a*) is fed through a system of rollers 28 that tension and properly direct the layline material through the system to the laser marking device 24. In this manner, the feeding mechanism 22 provides a controlled feed, tension, and positioning of the layline material from its spool source through the system to the laser marking device 24 that perform a laser treatment as further detailed below.

As referenced above, the layline material 10 (or 10*a*) includes a base carrier film having a first side 14 comprising an ink side, and a second side 15 opposite from the first side that is a non-ink side. In exemplary embodiments, the rollers 28 direct the layline material 10/10*a* in a manner by which the second, non-ink side 15 faces and passes by an encoder 30. The encoder 30 reads a position of the layline material 10, and based on the read position the encoder generates a trigger output signal to the laser marking device 24. The encoder trigger output signal controls operation of the laser marking device to control a timing of the laser treatment to the ink regions on the ink side 14 of the layline material as the ink regions pass by or through the laser marking device to form the pattern of labeling. Accordingly, the rollers 28 also direct the layline material 10/10*a* in a manner by which the first ink side 14 faces the laser marking device 24. In this manner, the feeding mechanism 22 allows laser treatment by the laser marking device to be applied to a specified area within the ink regions 18/18*a* of the layline material to form the pattern of labeling. Typical feed rates of the layline material are approximately between 60-250 feet per minute.

The laser treatment essentially may be a laser printing operation in which a first portion of ink is thermally removed from the ink region 18/18*a* to expose the carrier film 12. In other words, the laser burns off the first portion of ink from the ink side of the carrier film, leaving behind a second portion of ink remaining on the carrier film that has not been burned off. There is potential that the laser-treated first portion of the ink is not fully burned off, but such laser-treated ink that does not burn off instead will be bonded to the carrier film by the thermal action. As a result, the bond laser-treated ink will be removed when the carrier film is removed, as shown further below. In either event, whether burned off or bonded to the carrier film, the laser-treated first portion of ink is removed, ultimately leaving behind a second portion of ink remaining on the final product that has not been removed.

Figure 4:
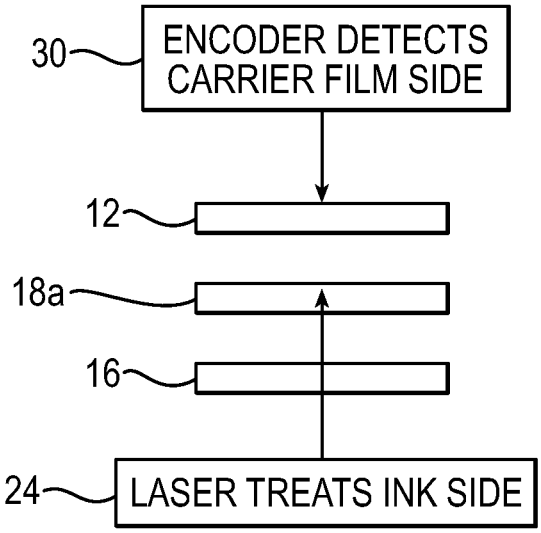
FIG. 4 is a drawing depicting a block diagram illustrating combined encoding and laser treatment processes.

FIG. 4 is a drawing depicting a block diagram illustrating the combined encoding and laser treatment processes. FIG. 4 illustrates the processes in connection with treating a two-layer print area configuration such as depicted in FIG. 2. The encoder 30 detects the ink regions 18*a* (white box) from the clear carrier film side, i.e., through the transparent carrier film 12, and tells laser when to turn on based on such detection. The laser 24 then laser treats the second background ink layer 16 and ink regions 18*a* from the ink side of the carrier film, which again either burns off the ink layers and/or bonds the laser treated ink portions to the carrier film for removal via removal of the carrier film.

Figure 5:
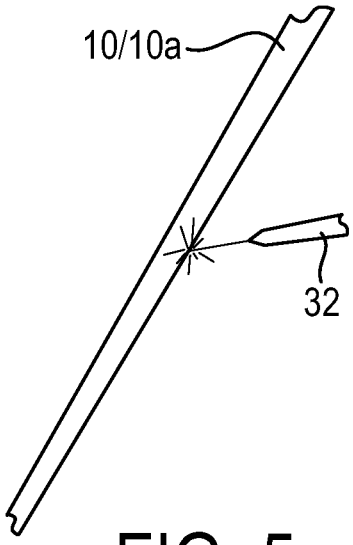
FIG. 5 is a drawing depicting operation of a laser beam being applied to the layline material to perform a laser treatment or printing operation.

Referring to FIG. 5, such figure illustrates the operation of a laser beam 32 being applied to the layline material 10/10*a* on the ink side. Based on control signals from the encoder 30, any desired patterning of laser treatment can be applied by thermally treating corresponding patterns of the ink regions. For example, variable product information, such as precise product dates and other specific product information, can be formed, as well as marketing information and graphics. The product information may include a MMDDYY date code, production information like lot number, etc., and any other desired product information, which can be variable information. In addition, any preprinted information, such as the conventional quarter date information, can be removed by burning off the preprinted data. In this manner, the layline material can be updated with more precise, accurate, and timely information, and since the preprinted quarter date can be removed, the potential for the layline material being outdated is removed.

Figure 6:
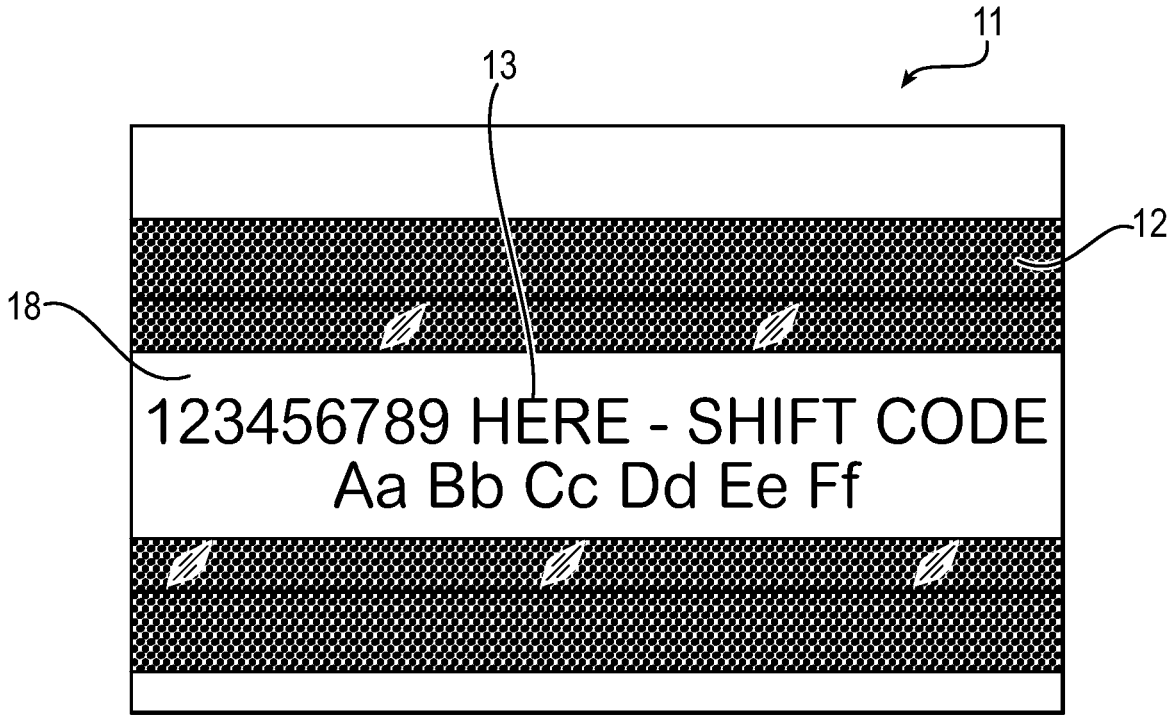
FIG. 6 is a drawing depicting a laser treated layline material having a single-layer print area configuration.
Figure 7:
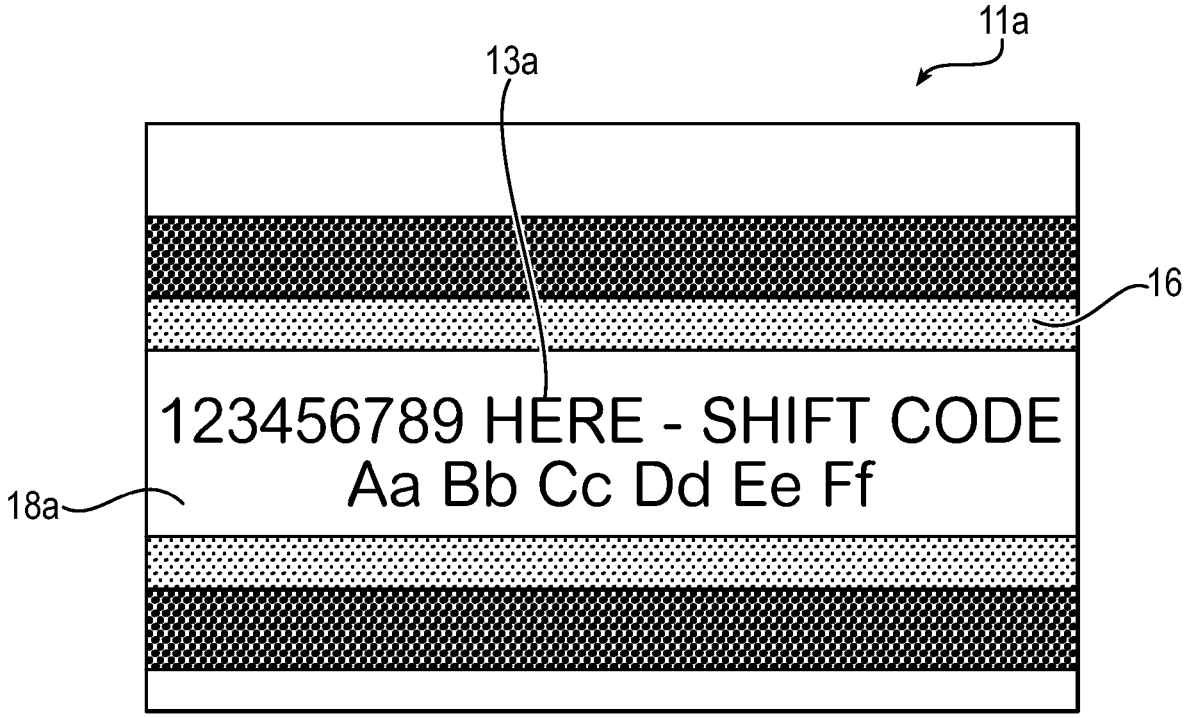
FIG. 7 is a drawing depicting a laser treated layline material having a two-layer print area configuration.

FIG. 6 is a drawing depicting a laser treated layline material 11, which is the layline material 10 after the laser treatment but prior to the adherence to a product such as a hose. As seen in the figure, ink has been removed from the ink region 18 to form a printed region 13 backed by the clear film 12, which is still in place at the processing stage of FIG. 6. FIG. 6 again is an example showing usage with a single-layer print area configuration. FIG. 7 is a drawing depicting a comparable laser treated layline material 11*a*, which is the layline material 10*a* after the laser treatment but prior to the adherence to a product such as a hose. Accordingly, FIG. 7 depicts laser treatment for the two-layer print area configuration. As seen in the figure, ink has been removed from the ink region 18*a* and second ink layer 16 to form a printed region 13*a* backed by the clear film above the second ink layer 16, which again is still in place at the processing stage of FIG. 7.

Referring back to the system depiction in FIG. 3, after laser treatment, an output roller 34 feeds the laser treated layline material 11/11*a* to a product application system 36. Generally, the product application system 36 applies the laser treated layline material 11/11*a* to the product. As referenced above, a suitable product for use with the described system and process is a hose product, and thus the product application system also is referred to by example as a hose application system 36. FIG. 3 thus shows a hose 38 being fed through the hose application system in the direction shown. In this example, the hose application system 36 may include an input roller 40 that guides the laser treated layline material 11/11*a* to a pair of opposing pressing rollers 42 and 44. Both the hose 38 and the layline material 11/11*a* are guided through the opposing pressing rollers 42 and 44, by which the laser treated layline material 11/11*a* is applied to the hose 38 with the ink side being pressed against the hose. In this manner, the laser treated layline material is applied to the hose with the ink side pressed against the outer hose cover. The hose application system 36 then outputs the hose 38 with the fixed laser treated layline material.

The product with the fixed laser treated layline material is then provided with a curing agent and cured. The curing process aids in pushing the layline material onto the hose. As in conventional hose manufacturing processes, the curing agent may be either an extruded plastic cover or a wrapped fabric which jackets the hose assembly during curing. In one example, the wrapped fabric jacket may be made of a nylon fabric, although other suitable fabric materials may be employed. In this example, the hose 38 with the fixed laser treated layline material 11 or 11*a* is cured in any suitable manner known in the art. During curing, the second portion of ink regions 18/18*a* that remains (i.e., ink that was not removed during the laser treatment), is bonded to an outer layer of the product, which in the example of a hose may be a hose cover layer.

Figure 8:
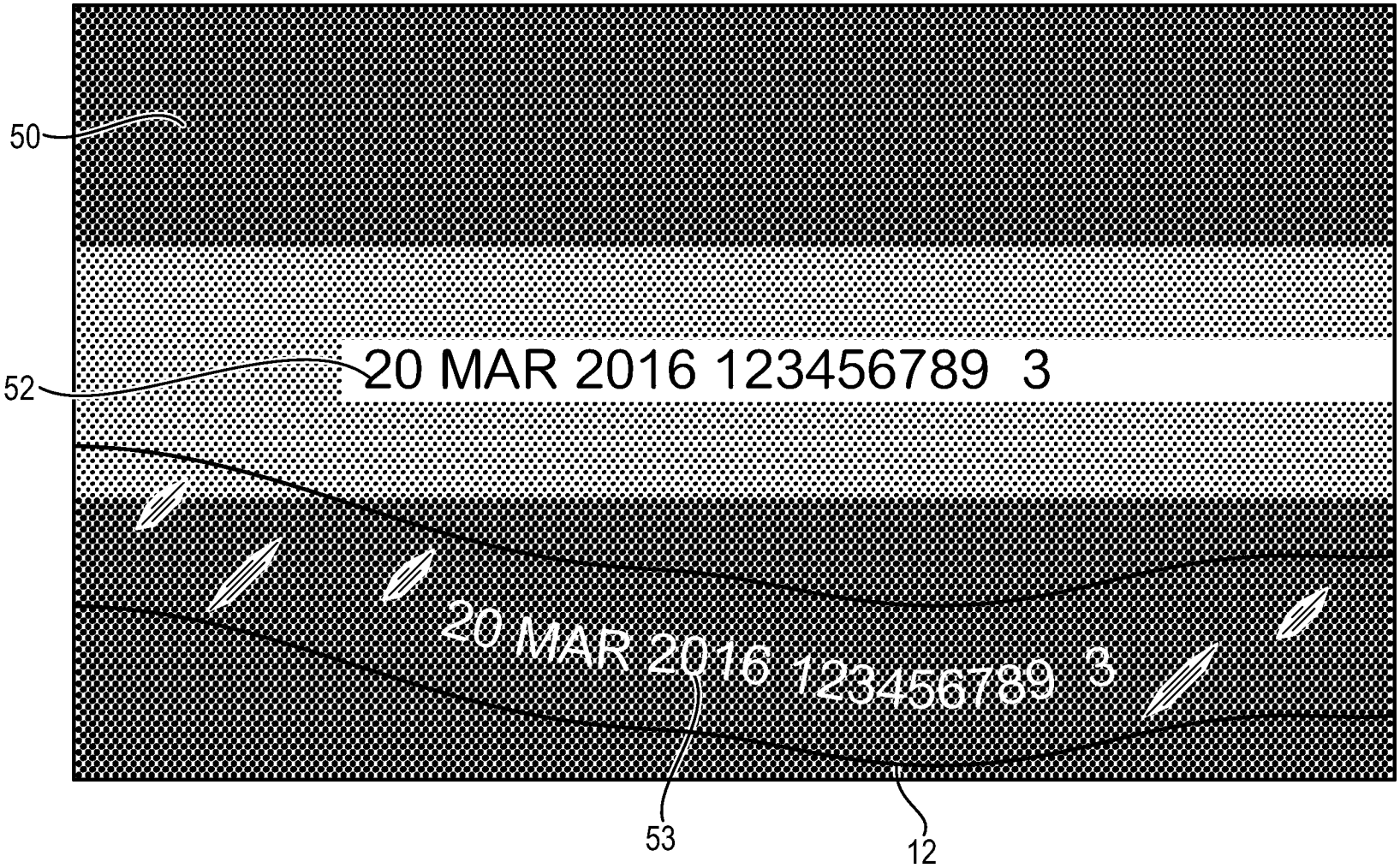
FIG. 8 is a drawing depicting removal of the carrier film layer of layline material from a hose assembly after curing, in which laser treated ink is transferred to the carrier film.

Curing also serves to separate the ink regions from the carrier film. The carrier film, therefore, may be peeled off or removed from the product (hose) as is known in the art of layline labeling. FIG. 8 is a drawing depicting removal of the carrier film layer 12 of a layline material from a hose assembly 50 after curing. Because of the laser treatment to form the pattern of labeling where the first portion of ink has been removed from the ink regions, labeling 52 is visible by the contrast of the outer layer of the product (e.g., hose cover) where the first portion of ink was burned away, against the remaining second portion ink that has bonded to such outer product layer during curing. FIG. 8 further shows that, as referenced above, some of the laser-treated ink has bonded to the carrier film rather than being burned off, as denoted by reference numeral 53. Accordingly, the ink portion 53 is removed with removal of the carrier film resulting in the visible labeling 52.

Figure 9:
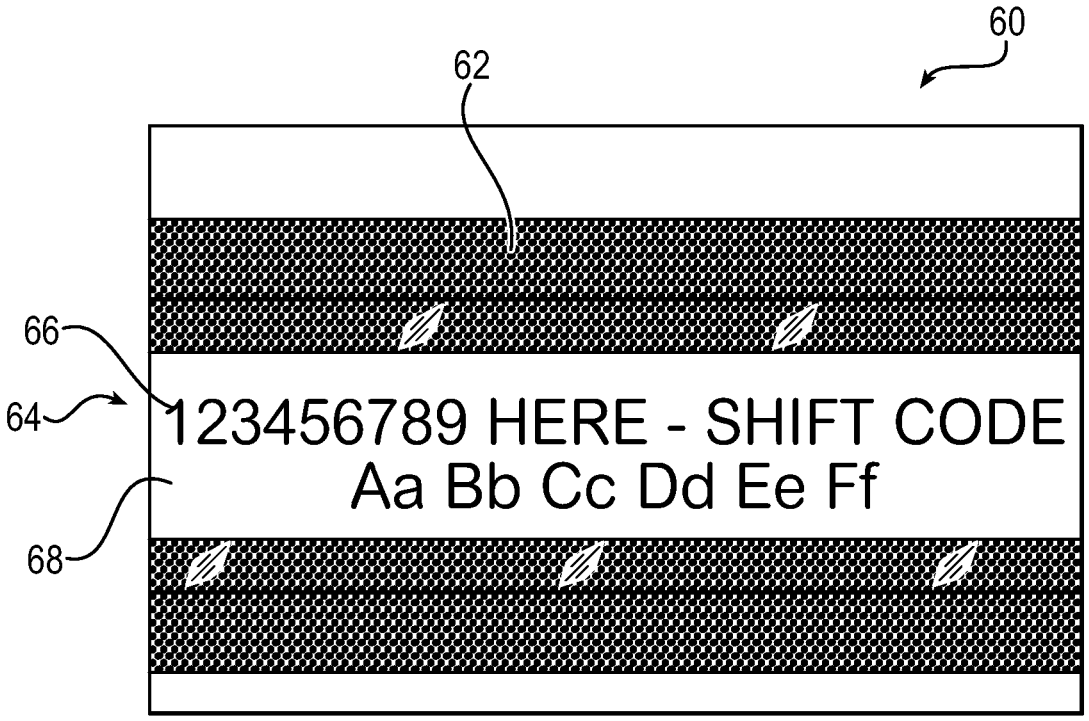
FIG. 9 is a drawing depicting an exemplary hose assembly that has been marked or labeled in accordance with embodiments of the present invention, using a layline material having a single-layer print area configuration.

FIG. 9 is a drawing depicting an exemplary hose assembly 60 that has been marked or labeled in accordance with the process described above. The hose assembly 60 in this example has been marked or labeled using a layline material having a single-layer print area configuration such as that depicted in FIGS. 1 and 6. Referring to the example of FIG. 9, the hose assembly 60 includes a black hose cover 62 onto which the layline material has been applied, laser treated, cured, and separated from the layline carrier film, as described above. A laser treated area 64 has patterned laser markings 66 that form the suitable pattern of labeling. With the laser treatment of the layline material, a first portion of the ink region of the laser treated area 64 has been removed to form the pattern of labeling 66, leaving a second portion 68 of the ink region not removed by the laser treatment as a contrasting background for the labeling. In other words, there is no white ink in the patterned portion 66 of the laser treated area 64, and the second portion 68 of the ink layer remains bonded to the hose cover as background, which has not been removed by the laser treatment. The underlying hose cover 62 provides contrast with the background ink portion 68 in the final look of the hose assembly, and thus the hose cover color appears as the characters of the pattern of labeling 66 in the laser treated area 64.

Figure 10:
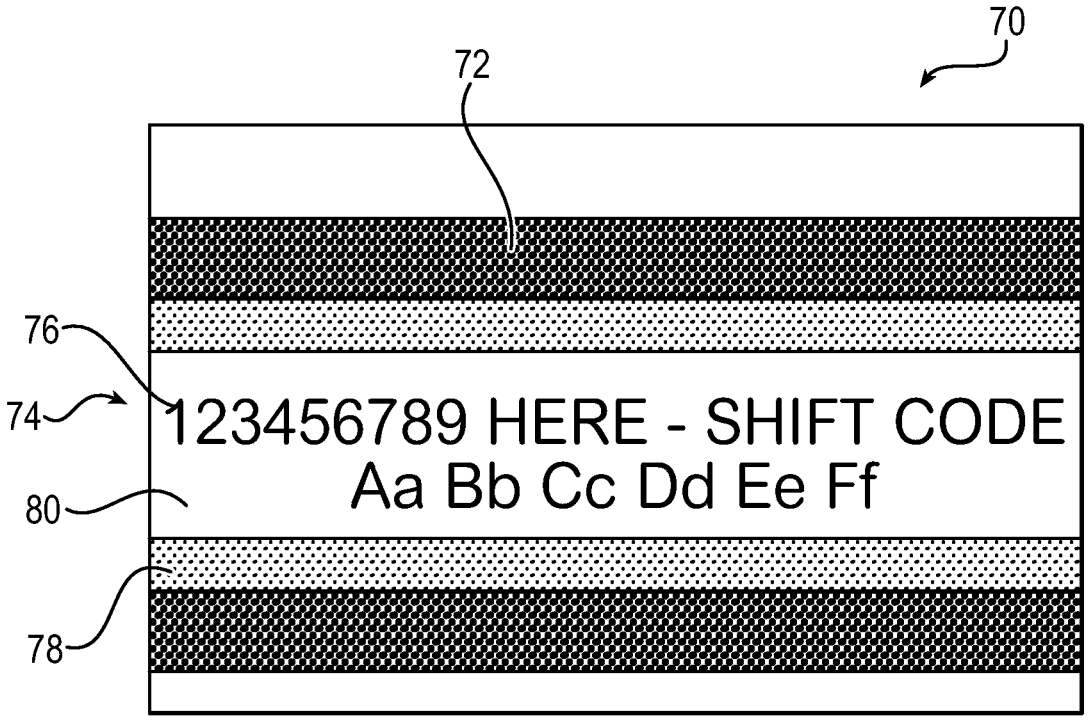
FIG. 10 is a drawing depicting an exemplary hose assembly that has been marked or labeled in accordance with embodiments of the present invention, using a layline material having a two-layer print area configuration.

FIG. 10 is a drawing depicting another exemplary hose assembly 70 that has been marked or labeled in accordance with the process described above. The hose assembly 70 in this example has been marked or labeled using a layline material having a two-layer print area configuration such as that depicted in FIGS. 2 and 7. Referring to the example of FIG. 10, the hose assembly 70 comparably includes a black hose cover 72 onto which the layline material has been applied, laser treated, cured, and separated from the layline carrier film, as described above. A laser treated area 74 has patterned laser markings 76 that form the suitable pattern of labeling. In this embodiment, as a two-layer print area configuration, the laser treated area 74 includes the ink region 80 (e.g., white) onto which is deposited the background second ink layer 78 (e.g., yellow). With the laser treatment of the layline material, a first portion of the ink region of the laser treated area 74 again has been removed to form the pattern of labeling 76, leaving a second portion of the ink region 80 as the white background for the labeling. In other words, there is no white ink in the patterned portion of the laser treated area, and the second portion of the ink region 80 remains bonded to the hose cover as background, which has not been removed by the laser treatment. The underlying hose cover 72 provides contrast with the background ink portion in the final look of the hose assembly against the background of the remainder second portion of the ink region, and thus the hose cover color appears as the characters of the pattern of labeling of the laser treated area 74. In the two-layer example of FIG. 10, additional contrast is provided by the contrast between the second ink layer 78 and the ink region 80 that includes the patterning, and the second ink layer 78 also has been removed as part of the patterning. To provide additional contrast, the second ink layer may be a darker ink layer relative to the other ink region, but again any suitable colors may be employed.

Advantages of the enhanced layline labeling of the present disclosure overcome the deficiencies of conventional layline processes. The present invention permits removal of the quarter date from the layline material, which eliminates the expiration concern by which the layline can become out of date. In addition, variable information can be labeled on the hose during the layline processes, which eliminates the need to add a separate ink print operation after the layline has been applied. This in turn avoids costs associated with ink printing, including avoiding ink and solvent cleaner costs related to ink printing. In addition to cost enhancement, environmental advantages are achieved by the elimination of ink processing supply needs, as well as increased power consumption that is needed for the additional printing. The enhanced layline labeling further results in improvement of finished product appearance, as variable data is printed on the existing layline and is easier to read than secondary ink printing, which may overlap the layline in conventional processes. There in turn is a reduced overall cost since laser printers as employed in the present invention have an expected lifespan of approximately 25% to 50% greater than the lifespan of analogous ink printers.

An aspect of the invention, therefore, is an enhanced method of labeling a product employing laser treatment to a layline material. In exemplary embodiments, the method of labeling a product comprising the steps of: providing a layline material including a carrier film and a plurality of ink regions applied to an ink side of the carrier film; applying a laser to laser-treat the ink side of the carrier film material to remove a first portion of ink from the ink regions of the carrier film to form a pattern of labeling; applying the laser treated layline material to a product with the ink side against the product; curing the product; and removing the carrier film after curing, wherein a second portion of the ink regions of the laser treated layline material not removed by the laser treatment remains bonded to an outer layer of the product to provide contrast with the pattern of labeling. The method of labeling may include one or more of the following features, either individually or in combination.

In an exemplary embodiment of the method of labeling a product, the ink regions each comprises a first ink layer and a second ink layer, and the laser removes the first portion of ink from first and second ink layers to form the patterning of labeling.

In an exemplary embodiment of the method of labeling a product, the first and second ink layers are different colors.

In an exemplary embodiment of the method of labeling a product, the method further includes: passing the layline material by an encoder; reading a position of the layline material with the encoder; and based on the read position, the encoder generating an output signal to a laser device to control a timing of the laser treatment to control the forming of the pattern of labeling.

In an exemplary embodiment of the method of labeling a product, the layline material includes a non-ink film side opposite from the ink side, and the layline material passes by the encoder with the non-ink film side facing the encoder.

In an exemplary embodiment of the method of labeling a product, the laser treatment burns off the first portion of ink from the ink regions on the ink side of the carrier film.

In an exemplary embodiment of the method of labeling a product, the method further includes cutting the laser treated layline material such that layline material including at least one ink region is applied to the product.

In an exemplary embodiment of the method of labeling a product, the method further includes providing the layline material from a spooled source of layline material, and feeding the layline material from the spooled source to a laser marking device that applies the laser to perform the laser treatment.

In an exemplary embodiment of the method of labeling a product, the carrier film is a polyethylene or polypropylene film.

In an exemplary embodiment of the method of labeling a product, the carrier film is Mylar.

In an exemplary embodiment of the method of labeling a product, the product is a hose product and the laser treated layline film is applied to an outer surface of the hose product.

Another aspect of the invention is a layline laser labeling system that employs the enhanced labeling method. In exemplary embodiments, the layline laser labeling system includes a laser marking device, and a feeding mechanism for feeding a layline material to the laser device. The layline material includes a carrier film and a plurality of ink regions applied to an ink side of the carrier film, and the laser marking device laser-treats the ink side of the layline material to remove a first portion of ink from the ink regions of the carrier film to form a pattern of labeling. The laser marking device may include one or more of the following features, either individually or in combination.

In an exemplary embodiment of the layline laser labeling system, the feeding mechanism includes a spool for providing the layline material and rollers for feeding spooled layline material to the laser marking device.

In an exemplary embodiment of the layline laser labeling system, the system further include an encoder, wherein: the feeding system passes the layline material by the encoder; the encoder reads a position of the layline material; and based on the read position the encoder generates an output signal to the laser marking device to control a timing of the laser treatment to control the forming of the pattern of labeling.

In an exemplary embodiment of the layline laser labeling system, the system further includes a product application system that applies the laser treated layline material to a product and removes the carrier film, wherein another portion of the ink regions of the laser treated layline material not removed by the laser treatment remains bonded to the carrier film.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A method of labeling a product comprising the steps of:
providing a layline material including a carrier film and a plurality of ink regions applied to an ink side of the carrier film;
applying a laser to laser-treat the ink side of the carrier film material to remove a first portion of ink from the ink regions of the carrier film to form a pattern of labeling;
applying the laser treated layline material to a product with the ink side against the product;
curing the product; and
removing the carrier film after curing, wherein a second portion of the ink regions of the laser treated layline material not removed by the laser treatment remains bonded to an outer layer of the product to provide contrast with the pattern of labeling.

2. The method of labeling a product of claim 1, wherein the ink regions each comprises a first ink layer and a second ink layer, and the laser removes the first portion of ink from first and second ink layers to form the patterning of labeling.

3. The method of labeling a product of claim 2, wherein the first and second ink layers are different colors.

4. The method of labeling a product of claim 1, further comprising:
passing the layline material by an encoder;
reading a position of the layline material with the encoder; and
based on the read position, the encoder generating an output signal to a laser device to control a timing of the laser treatment to control the forming of the pattern of labeling.

5. The method of labeling a product of claim 4, wherein the layline material includes a non-ink film side opposite from the ink side, and the layline material passes by the encoder with the non-ink film side facing the encoder.

6. The method of labeling a product of claim 1, wherein the laser treatment burns off the first portion of ink from the ink regions on the ink side of the carrier film.

7. The method of labeling a product of claim 1, further comprising cutting the laser treated layline material such that layline material including at least one ink region is applied to the product.

8. The method of labeling a product of claim 1, further comprising providing the layline material from a spooled source of layline material, and feeding the layline material from the spooled source to a laser marking device that applies the laser to perform the laser treatment.

9. The method of labeling a product of claim 1, wherein the carrier film is a polyethylene or polypropylene film.

10. The method of labeling a product of claim 1, wherein the carrier film is Mylar.

11. The method of labeling a product of claim 1, wherein the product is a hose product and the laser treated layline film is applied to an outer surface of the hose product.

12. A layline laser labeling system comprising:
a laser marking device; and
a feeding mechanism for feeding a layline material to the laser device;
wherein the layline material includes a carrier film and a plurality of ink regions applied to an ink side of the carrier film, and the laser marking device laser-treats the ink side of the layline material to remove a first portion of ink from the ink regions of the carrier film to form a pattern of labeling; and
further comprising a product application system that applies the laser treated layline material to a product and removes the carrier film, wherein another portion of the ink regions of the laser treated layline material not removed by the laser treatment remains bonded to the carrier film.

13. The layline labeling system of claim 12, wherein the feeding mechanism includes a spool for providing the layline material and rollers for feeding spooled layline material to the laser marking device.

14. The layline labeling system of claim 12, further comprising an encoder, wherein:
the feeding system passes the layline material by the encoder;
the encoder reads a position of the layline material; and
based on the read position the encoder generates an output signal to the laser marking device to control a timing of the laser treatment to control the forming of the pattern of labeling.

* * * * *